US009786419B2

(12) United States Patent
Liang et al.

(10) Patent No.: US 9,786,419 B2
(45) Date of Patent: Oct. 10, 2017

(54) GRAIN BOUNDARY DIFFUSION PROCESS FOR RARE-EARTH MAGNETS

(71) Applicant: Ford Global Technologies, LLC, Dearborn, MI (US)

(72) Inventors: Feng Liang, Troy, MI (US); C Bing Rong, Canton, MI (US); Michael W. Degner, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 757 days.

(21) Appl. No.: 14/049,443

(22) Filed: Oct. 9, 2013

(65) Prior Publication Data

US 2015/0099104 A1 Apr. 9, 2015

(51) Int. Cl.

| | |
|---|---|
| ***H01F 1/055*** | (2006.01) |
| ***B22F 3/12*** | (2006.01) |
| ***B22F 5/00*** | (2006.01) |
| ***H01F 1/053*** | (2006.01) |
| ***H01F 41/02*** | (2006.01) |

(Continued)

(52) U.S. Cl.

CPC ..... *H01F 1/0557* (2013.01); *B22F 3/12* (2013.01); *B22F 5/00* (2013.01); *H01F 1/0536* (2013.01); *H01F 41/0266* (2013.01); *H01F 41/0293* (2013.01); *B22F 7/06* (2013.01); *B22F 2302/25* (2013.01); *B22F 2302/45* (2013.01); *B22F 2998/10* (2013.01); *B22F 2999/00* (2013.01);

(Continued)

(58) Field of Classification Search

None

See application file for complete search history.

(56) References Cited

U.S. PATENT DOCUMENTS

| | | | | |
|---|---|---|---|---|
| 4,076,561 A | | 2/1978 | Lee et al. | |
| 5,379,004 A | * | 1/1995 | Marusawa | H01P 1/32 156/89.12 |

(Continued)

FOREIGN PATENT DOCUMENTS

| | | |
|---|---|---|
| CN | 101859639 A | 10/2010 |
| JP | 2003272942 A | 9/2003 |

(Continued)

OTHER PUBLICATIONS

Sagawa, M. et al., "Permanent magnet materials based on the rare earth-iron-boron tetragonal compounds", Magnetics, IEEE Transactions, Sep. 1984, vol. 20, Issue 5, abstract.

(Continued)

*Primary Examiner* — Tahseen N Khan

(74) *Attorney, Agent, or Firm* — David Kelley; Brooks Kushman P.C.

(57) ABSTRACT

In at least one embodiment, a single sintered magnet is provided having a concentration profile of heavy rare-earth (HRE) elements within a continuously sintered rare-earth (RE) magnet bulk. The concentration profile may include at least one local maximum of HRE element concentration within the bulk such that a coercivity profile of the magnet has at least one local maximum within the bulk. The magnet may be formed by introducing alternating layers of an HRE containing material and a magnetic powder into a mold, pressing the layers into a green compact, and sintering the green compact to form a single, unitary magnet.

14 Claims, 3 Drawing Sheets

(51) Int. Cl.
*H01F 1/057* (2006.01)
*B22F 7/06* (2006.01)

(52) U.S. Cl.
CPC ..... *C22C 2202/02* (2013.01); *H01F 1/0577* (2013.01)

(56) References Cited

U.S. PATENT DOCUMENTS

| | | | |
|---|---|---|---|
| 5,935,722 | A | 8/1999 | Moorhead et al. |
| 7,285,338 | B2 | 10/2007 | Yamashita et al. |
| 7,498,088 | B2 | 3/2009 | Kobayashi et al. |
| 8,182,619 | B2 | 5/2012 | Morimoto et al. |
| 8,187,392 | B2 | 5/2012 | Yoshimura et al. |
| 2006/0051233 | A1 | 3/2006 | Ugai et al. |
| 2010/0171386 | A1 | 7/2010 | Kogure et al. |
| 2011/0012460 | A1 | 1/2011 | Ozeki et al. |
| 2011/0128106 | A1 | 6/2011 | Mori et al. |
| 2011/0200839 | A1 | 8/2011 | Marinescu et al. |
| 2011/0210810 | A1 | 9/2011 | Miyata et al. |
| 2012/0153759 | A1 | 6/2012 | Kawashita et al. |
| 2012/0206227 | A1* | 8/2012 | Yoshimura ..... B22F 3/24 335/302 |
| 2013/0038164 | A1 | 2/2013 | Liu et al. |
| 2013/0093551 | A1 | 4/2013 | Peng et al. |

FOREIGN PATENT DOCUMENTS

| | | | |
|---|---|---|---|
| JP | 2008060241 | A | 3/2008 |
| WO | 2006109615 | A1 | 10/2006 |
| WO | 2007119271 | A1 | 10/2007 |

OTHER PUBLICATIONS

Peter C. Dent et al., "High Electrical Resistivity Permanent Magnets for Advanced Motors", Electron Energy Corporation, Nov. 2009, pp. 1-57.

English Translation of First Chinese Office Action, dated Jun. 14, 2017 for related Chinese Patent Application No. 0140502558.X.

First Chinese Office Action, dated Jun. 14, 2017 for related Chinese Patent Application No. 20140502558.X. No English Translation available.

* cited by examiner

GRAIN BOUNDARY DIFFUSION PROCESS FOR RARE-EARTH MAGNETS

TECHNICAL FIELD

One or more embodiments relate to a process for producing rare-earth magnets with reduced heavy rare-earth elements.

BACKGROUND

Permanent magnet motors may have high efficiency, making them potentially suitable for use in traction motors for hybrid and electric vehicles. The design and choice of the permanent magnet is important in this type of motor. Rare-earth permanent magnets, such as neodymium (Nd) magnets, are often used in the traction motors in electric vehicles due to their high flux density and high anti-demagnetizing ability compared with traditional non-rare-earth magnets, such as alnico (iron alloys including aluminum, nickel, and cobalt) and ferrite. However, rare-earth permanent magnets may contain a large amount of rare-earth elements (e.g., at least 30 wt % in some commercial magnets), which makes the magnets expensive. In addition, to ensure the high-temperature operation of permanent magnet in the transmission environment of vehicles, about 10 wt % heavy rare-earth (HRE) elements, such as dysprosium (Dy) and terbium (Tb), may need to be added into neodymium magnetic alloys. This makes the magnets even more expensive, since the price of Dy and Tb may be about ten times higher than that of neodymium.

SUMMARY

In at least one embodiment, a magnet is provided comprising a single sintered magnet having a concentration profile of heavy rare-earth (HRE) elements within a continuously sintered rare-earth (RE) magnet bulk. The concentration profile may include at least one local maximum of HRE element concentration located between local minimums of the HRE element concentration within the bulk such that a corresponding coercivity profile of the magnet has at least one local maximum located between local minimums within the bulk.

In another embodiment, the concentration profile of HRE elements includes a plurality of local maximums of HRE element concentration within the bulk. The concentration profile of HRE elements may be periodic, having alternating relative maximums and minimums or the concentration profile of HRE elements may be substantially sinusoidal in shape. In another embodiment, the single sintered magnet has a thickness greater than 6 mm. The RE magnet bulk may include at least one of an RE—Fe—B or Sm—Co alloy. The magnet may further comprise electrically resistive material within the bulk, which may be formed as at least one layer within the bulk. In one embodiment, there may be a concentration profile of electrically resistive material within the bulk that is periodic, having alternating relative maximums and minimums. The electrically resistive material may include a magnetic material.

In at least one embodiment, a method of forming a rare-earth magnet is provided. The method may include introducing alternating layers of a material including a heavy rare-earth (HRE) element or alloy and a magnetic powder including a rare-earth (RE) element or alloy into a mold, compacting the layers into a green compact, and sintering the green compact to form a rare-earth magnet having HRE elements diffused into a rare-earth element bulk.

In one embodiment, at least three layers of material including a HRE element or alloy are introduced into the mold. The layers of material including a HRE element or alloy may have a thickness of 25 to 250 μm. The layers of material including a HRE element or alloy may each have the same thickness. In one embodiment, the material including a HRE element or alloy is a powder. The powder may be selected from one of DyF3, TbF3, Dy203, Tb2O3, and DyFe. In another embodiment, the material including a HRE element or alloy is a liquid. The material including a HRE element or alloy may be mixed with an electrically resistive material prior to being introduced into the mold. In one embodiment, the electrically resistive material includes a magnetic material.

In at least one embodiment, a rare-earth magnet is provided. The magnet may comprise a green compact including a compressed layer of magnetic powder including a rare-earth element or alloy and at least two layers of a material including a heavy rare earth (HRE) element or alloy.

DETAILED DESCRIPTION

Figure 1A:
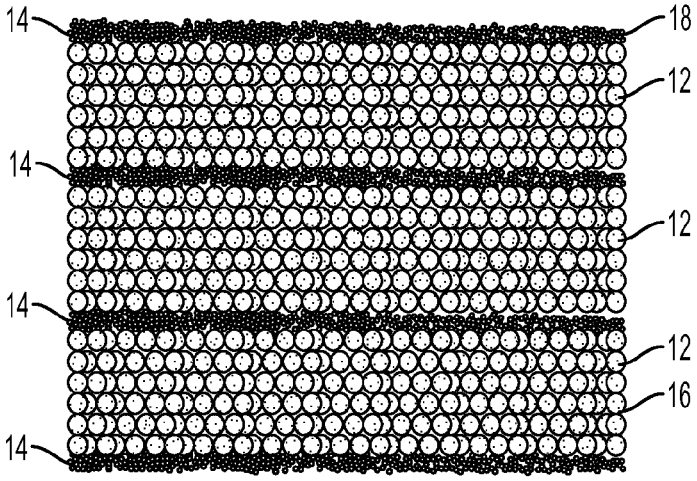
FIG. 1A is a schematic of a layered magnet assembly having alternating layers of heavy rare-earth (HRE) containing material and a magnetic powder.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Due to the relatively high cost of rare-earth (RE) magnets including heavy rare-earth (HRE) elements, it would be beneficial to reduce the amount of HRE elements used while still maintaining the enhanced properties provided by the HRE elements. One method of reducing the amount of HRE elements used in permanent magnets is to apply a layer or coating of HRE media to the surface of sintered magnets, followed by a heat treatment to enhance diffusion. The sintered magnets may be any suitable rare-earth magnets, for example a neodymium-iron-boron magnet, in which the sintered magnet has grains of $Nd_2Fe_{14}B$ and grain boundaries including an Nd-rich phase.

The method may be a grain boundary diffusion process (herein after referred to as the GBDP), including coating a surface of the sintered magnets with a layer including HRE elements, for example, by wet-coating or metal evaporation. The magnets may then be heated to a temperature at which the Nd-rich grain boundaries melt, thereby significantly increasing the diffusion of the HRE elements into the grain boundaries. During this process, some of the HRE elements further diffuse into the outer shell of the grains, for example, $Nd_2Fe_{14}B$ grains. The HRE elements in the outer shell provide an increased anisotropy field and increased anti-demagnetizing properties of the magnets, resulting in increased coercivity in the magnets.

While the grain boundary diffusion process discussed above may increase coercivity and reduce the amount of HRE elements required compared to mixing HRE elements in with the original magnet alloy, further reduction in HRE elements would be beneficial for reducing costs. In addition, the GBDP described above has a maximum diffusion depth of about 3 mm. This means that if two opposing surfaces of the magnet are coated with a layer including HRE elements, the maximum thickness of the magnet is about 6 mm. In some applications, it may be beneficial or necessary to have magnets thicker than 6 mm. While it may be possible to stack together multiple magnets treated using the GBDP described above to form a magnet having a thickness greater than 6 mm, such a stacked magnet has poor mechanical properties. For example, magnets thinner than 6 mm may be glued together to form a magnet thicker than 6 mm, but the glue has poor mechanical strength compared to a unitary magnet. Mechanical bundling of thin magnets is also possible to form a magnet thicker than 6 mm, but it has extra cost and may not practical in some applications.

Figure 1B:
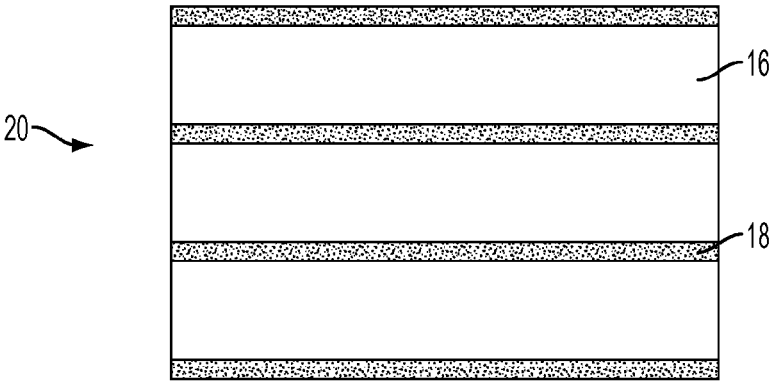
FIG. 1B is a schematic of the layered assembly of FIG. 1A pressed into a green compact.
Figure 1C:
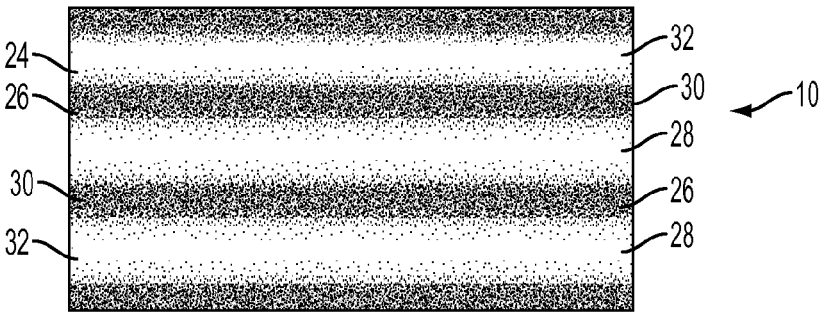
FIG. 1C is a schematic of the green compact of FIG. 1B sintered into a magnet having HRE containing material present throughout the bulk of the magnet.

With reference to FIGS. 1A to 1C, a process is shown for forming a magnet 10 having a flexible thickness range and more homogeneous properties than in the GBDP described above. The magnetic powder 12 that forms the bulk of the magnet may be any suitable magnetic material. In one embodiment, the magnetic powder 12 is rare-earth magnetic powder. Examples of suitable rare-earth magnetic compositions include, but are not limited to, RE—Fe—B and Sm—Co, wherein RE is a rare-earth element, such as Nd, Pr, Sm, Gd, or others. The magnetic powders 12 may be prepared by alloying and pulverizing, however other suitable methods may be used.

As shown in FIG. 1A, the magnetic powder 12 may be layered with an HRE element-containing material 14 in a mold or die (not shown). The HRE-containing material 14 may be a powder, such as $DyF_3$, $TbF_3$, $Dy_2O_3$, $Tb_2O_3$, DyFe alloys, or others. The HRE-containing material 14 may also be a liquid solution/suspension that includes one or more HRE elements, such as Tb, Dy, Ho, Er, Tm, Yb, Lu, or Y. The magnetic powder 12 and the HRE-containing material 14 may be alternately layered to form magnetic powder layers 16 and HRE layers 18. The HRE layers 18 may have a uniform thickness throughout or they may have varying thickness. In addition, the HRE layers 18 may or may not be parallel to each other and may intersect in some embodiments. In at least one embodiment, the HRE layers 18 form a continuous layer across an entire dimension (e.g., width) of the magnet. However, in some embodiments the HRE layers 18 may not form a continuous layer (e.g., the magnetic powder layers may contact each other).

In one embodiment, the first and last layers of the magnet 10 are the HRE-containing material 14. Once the magnetic powder 12 and the HRE-containing material 14 have been inserted into the mold or die, the layered assembly may be pressed into a green compact 20. In one embodiment, the pressure used to form the green compact 20 may be from 100 to 1000 MPa. In another embodiment, the pressure used to form the green compact 20 may be from 250 to 750 MPa. In at least one embodiment, the green compact 20 may be pressed to a density of 40 to 80% (e.g., percent of theoretical density). In another embodiment, the green compact 20 may be pressed to a density of 50 to 70%. During the pressing step, a magnetic field 22 may be applied to the layered assembly to give the resulting magnet 10 the desired magnetic orientation and properties. The magnetic field direction may be designed according to an application. For example, the magnetic field direction could be parallel or perpendicular to the layer direction in some embodiments. In other embodiments, the field direction may be neither parallel or perpendicular to the layer direction (e.g., oblique). A radiational field may also be applied, the radiational field configured to cause the final magnet to have radiational easy-axes (e.g., the easy axes extend generally outward from the center in a radial direction). In some embodiments, the applied external field may be from 0.2 T to 2.5 T to assist the alignment of magnetic powder 12 during pressing. However, any suitable applied external field may be used.

After the layered assembly is pressed, it is sintered to form a solid, unitary magnet 10. The solid, unitary magnet 10 may be described as being "continuously sintered," in that each layer is sintered to the adjacent layer, rather than bonded after sintering (e.g., using adhesive, mechanical fasteners, or other known methods). As shown in FIG. 1B, during the intermediate stage of the sintering process, the HRE-containing material 14 (shown in FIGS. 1A-1C as a powder) initially forms layers 18 between the pressed magnetic powder 12. As the sintering process progresses, the grain boundaries, which may be rare-earth rich (e.g., Nd-rich), melt and allow for enhanced diffusion of the HRE-containing material 14 into the grain boundaries. In addition to the grain boundaries, the HRE elements diffuse into the outer shell of the grains, which increases the anisotropy field and anti-demagnetizing ability of the magnet 10. The process therefore may combine sintering and diffusing in a single step, rather than separate sintering and diffusing steps. Combining sintering and diffusing into a single step may allow for better control of the HRE diffusion and provide reduced overall processing time, energy, cost, and materials.

With reference to FIG. 1C, the magnet 10 may have a concentration profile or gradient 24 of HRE containing material 14 after sintering. The profile 24 may vary depending on the number, thickness, concentration of HRE content of the HRE layers 18, and spacing of HRE layers 18 and/or the time and temperature of the sintering process, as well as other processing parameters. In at least one embodiment, the concentration profile 24 of HRE material 14 has at least one local maximum 26 of HRE concentration within the bulk of the magnet 10 (e.g., not at the opposing surfaces of the magnet). The local maximum 26 may be located between local minimums 28 of HRE concentration in the concentration profile. In another embodiment, there is a plurality of local maximums 26 of HRE concentration within the bulk of the magnet 10. As used herein, "local maximum" (or relative maximum) refers to a concentration level peak or maximum within a localized region. At the local maximum 26, the HRE concentration is higher than on either side of the local maximum 26. A given local maximum 26 may also be the global or overall maximum (e.g., the highest HRE concentration may occur within the bulk). A sintered magnet having an HRE concentration profile 24 with a local maximum 26 within the bulk is another distinguishing feature over a GBDP magnet, in which diffusion will cause the gradient to continuously decrease towards a center of the magnet, which will have a local minimum.

In another embodiment, the magnet may have a concentration profile 24 of HRE elements that is periodic, having alternating relative maximums 30 and minimums 32. As used herein, "periodic" may include, but does not require, identical or regular intervals. With reference to FIG. 3C, in regions where the HRE layers 18 were originally located before sintering, there are relative maximums 30 and in regions where there was originally magnetic powder 12, there are relative minimums 32. In general, each layer 18 of HRE containing material 14 will result in a local maximum 30. In one embodiment, the concentration profile 24 of HRE elements is substantially sinusoidal in shape. This may occur when the layers 18 are substantially evenly spaced and have similar or the same thicknesses.

In at least one embodiment, the sintering temperature may be in the range of 800 to 1150° C. The sintering time may depend on the sintering temperature, but may vary from 1 to 24 hours, for example. In general, higher sintering temperatures will require less sintering time, while lower temperature will require longer sintering times. However, sintering temperature and time may be adjusted as necessary to achieve a fully sintered magnet 10. Once sintering is complete, a permanent magnet 10 is formed having HRE elements diffused substantially throughout the thickness of the magnet 10. As a result, the coercivity of the magnet may be significantly enhanced following the diffusion process. Compared to a conventional GBDP process, the described embodiment only requires a single step heat treatment.

Due to the multiple layers 18 of HRE-containing material 14 within the layered assembly, the diffusion distance between layers 18 of HRE material 14 is significantly reduced compared to the GBDP described above in which the HRE material 14 is applied to two surfaces of already sintered magnets. As a result, the coercivity of the magnet is more consistent throughout the thickness of the magnet 10 compared to the GBDP. The difference in coercivity for a magnet of the same thickness formed using the layered assembly compared to the GBDP is shown schematically in FIG. 2. While the coercivity profile 34 of the layered assembly magnet 10 still has peaks 36 at depths corresponding to the local maximum(s) 26 of the HRE-material layers 18, the valleys 38 (corresponding to local minimum(s) 28) are much shallower than in the GBDP magnet due to the reduced diffusion distance of the HRE material 14 and because the HRE material 14 was present during sintering rather than being applied as a layer on an already sintered magnet.

The coercivity profile 34 may be controlled by the thickness or HRE concentration of HRE layers 18. In one embodiment, the outer HRE layer(s) 18 may be thicker or have higher HRE content than the inner HRE layers. This may produce a final sintered magnet having larger coercivity/anti-demagnetizing ability in outer/corner regions, which may be useful for permanent magnet motors requiring higher coercivity in the magnet surface/corner.

Magnets 10 having a layered assembly of magnetic powder 12 and HRE-containing 14 material may have any substantially reasonable thickness. Unlike the GBDP, which has an effective maximum thickness of 6 mm due to the limits of diffusion from the surfaces, the layered assembly magnet may have a thickness exceeding 6 mm while still having high coercivity throughout. In one embodiment, the layered assembly magnet has a thickness of at least 10 mm. In another embodiment, the layered assembly magnet has a thickness of at least 15 mm. In another embodiment, the layered assembly magnet has a thickness of at least 20 mm. In another embodiment, the layered assembly magnet has a thickness of at least 25 mm. Accordingly, layered assembly magnets may be large enough to replace multiple magnets assemblies or for applications in which GBDP magnets are insufficient.

Figure 2:
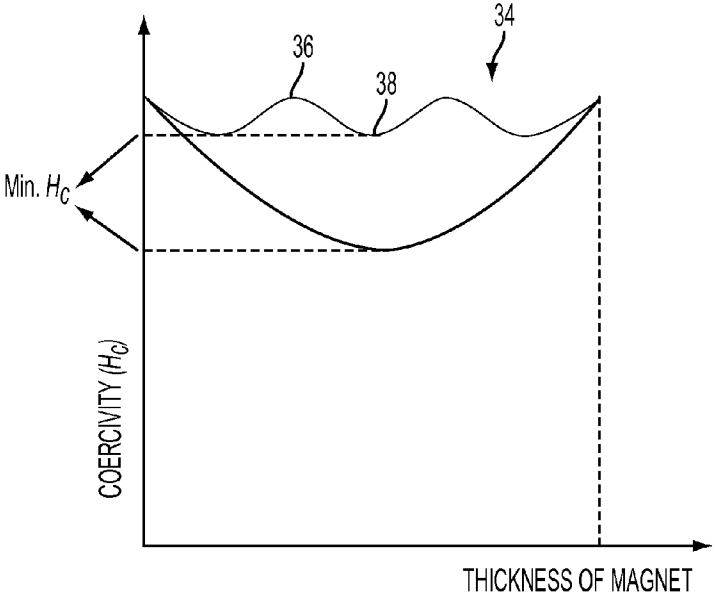
FIG. 2 is a schematic coercivity profile showing the coercivity of a layered magnet compared to the coercivity profile of a conventional grain boundary diffusion process magnet.
Figure 4A:
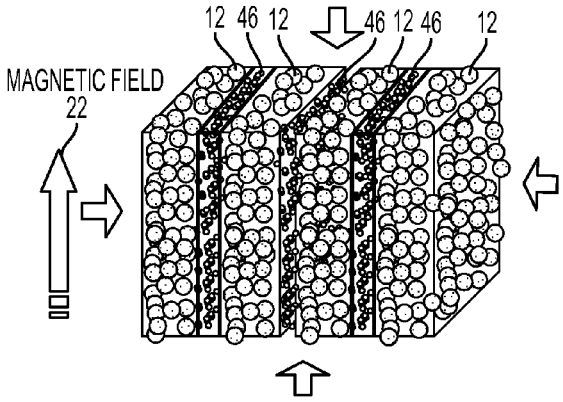
FIG. 4A a schematic of a layered magnet assembly having alternating layers of electrically insulating material and a magnetic powder with a magnetic field oriented in a vertical direction.
Figure 4B:
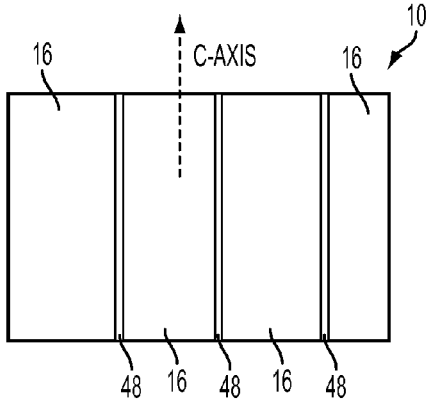
FIG. 4B is a schematic of a sintered magnet having electrically insulating layers parallel to the c-axis of magnetic hard phase.
Figure 4C:
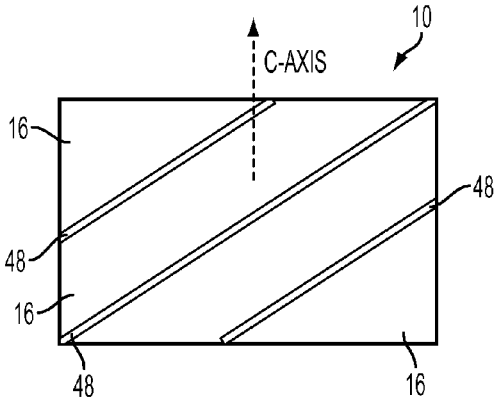
FIG. 4C is a schematic of a sintered magnet having electrically insulating layers oblique to the c-axis of magnetic hard phase.
Figure 4D:
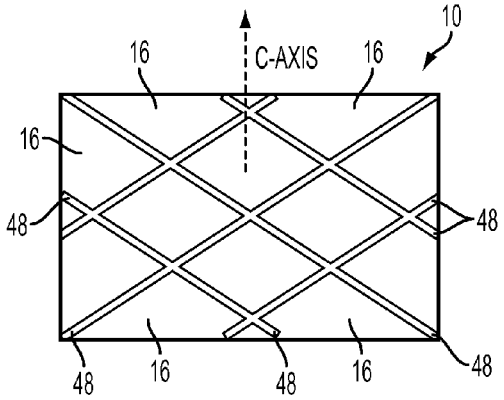
FIG. 4D is a schematic of a sintered magnet having electrically insulating layers in a networked configuration relative to the c-axis of magnetic hard phase.

In addition to the advantages of making thicker magnets and achieving more uniform coercivity distribution, the disclosed method has the additional benefit of allowing tuned magnetic profiles (e.g. coercivity) for different applications. For example, the coercivity ($H_c$) profile 34 shown in FIG. 2 is tunable by the number of the HRE-containing layers 18 and each magnet sub-layer 16, 18 thickness. The period modulation of $H_c$ profile 34 may be tuned by the number of the HRE-containing layers 18, while the thickness of each magnet 10 may determine the value of minimum coercivity.

The number of layers 18 of HRE-containing material 14 in the magnet 10 and their thickness may vary depending on the overall thickness of the magnet 10 and the desired level of coercivity, as well as other factors. In at least one embodiment, the layered assembly has at least 3 layers 18 of HRE-containing material 14 prior to sintering. However, the number of layers may vary depending on the thickness of the magnet, the thickness of the HRE layers 18, and the desired magnetic properties of the magnet 10. For example, the magnet 10 may include at least 4, 5, 6, 10 or more layers 18 of HRE-containing material 14 prior to sintering. In one embodiment, the outer layers of the layered assembly are each HRE-containing material 14. However, all of the HRE-containing layers 18 may be within the bulk of the layered assembly. The number of layers 18 of HRE-containing material 14 may be defined as a ratio of layers to mm of thickness. For example, if a magnet has a thickness of 6 mm and has 3 layers of HRE-containing material, the ratio would be 3:6, or 1:2. In at least one embodiment, the ratio of HRE-containing layers to mm of thickness is at least 1:3. In another embodiment, the ratio of HRE-containing layers to mm of thickness is at least 1:2. In another embodiment, the ratio of HRE-containing layers to mm of thickness is at least 1:1. In another embodiment, the ratio of HRE-containing layers to mm of thickness is at least 3:2. In another embodiment, the ratio of HRE-containing layers to mm of thickness is at least 2:1.

The thickness of the HRE-containing material layers 18 may vary depending on the number of layers and the overall thickness of the magnet. The HRE-containing layers 18 may be thick enough that they contain sufficient HRE material 14 to diffuse at least halfway to the adjacent HRE-containing layer 18. In at least one embodiment, the HRE-containing material layers 18 each have a thickness of 25 to 250 μm prior to sintering. In another embodiment, the HRE-containing material layers 18 each have a thickness of 50 to 150 μm prior to sintering. In another embodiment, the HRE-containing material layers 18 each have a thickness of 50 to 100 μm prior to sintering. The sintered magnet 10 may have any suitable HRE content depending on the desired magnetic properties. In at least one embodiment, the sintered magnet 10 has from 1 to 8 wt % HRE. In another embodiment, the sintered magnet 10 has from 1.5 to 5 wt % HRE. In another embodiment, the sintered magnet 10 has from 1.5 to 4 wt % HRE.

The disclosed method is not only suitable for near-shape pressed magnets, but may also be applicable to large or "big block" magnets. If big block magnets are produced during manufacturing, the disclosed method may provide more benefits on time and/or cost savings. For conventional GBDP using a big block magnet, the block must be cut into a shape close to the final application and then the GBDP process must be applied to each magnet. In the disclosed method, the diffusion process may be done in the big block magnet. First, the HRE layers 18 may be prepared during the pressing process. The number of layers and thickness of layers may depend on the application requirement. Second, sintering/diffusion may performed. Third, the big block can be cut/ground into multiple smaller magnets for one or more applications without further heat treatment. Therefore, the time consuming individual HRE coating process of GBDP for each smaller magnet may be avoided.

In at least one embodiment, in addition to increasing magnet thickness, coercivity, and homogeneity, the layered assembly process may be used to increase electrical resistance within the magnet. Increased electrical resistance may reduce eddy current losses that may occur within the magnet. The layered assembly process may be substantially similar to the one described above, but with the addition of electrically insulating material 40 to the HRE-containing material 14 prior to the layering process. For example, an electrically insulating material 40 may be mixed with an HRE-containing material 14 and the mixture 42 may be alternately layered with magnetic powder 12 to form a layered assembly. Instead of mixing the insulating material 40 and the HRE-containing material 14, the HRE-containing layers 18 and insulating layers 44 may also be separately layered in the magnet 10. For example, the layered structure may be HRE-insulating-magnetic-insulating-HRE-insulating-magnetic-insulating-HRE, or HRE-magnetic-insulating-magnetic-HRE, or any other combination. The layered assembly may then be pressed under an external magnetic field 22 and subsequently sintered to form a permanent magnet 10, according to the process described above. The electrically insulating material 40 may be any suitable sinterable material, for example, a ceramic powder. In one embodiment, the insulating material 40 is a fluoride or oxide of Ca, Mg, Li, Sr, Na, Ba Sr, or Fe, or others, such as $SiO_2$, etc.

Figure 3A:
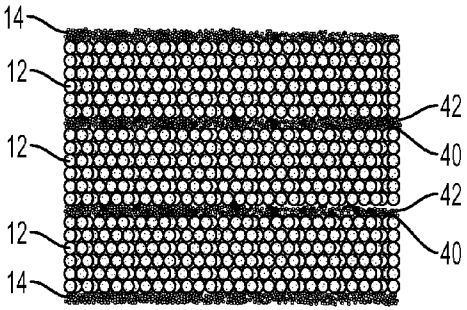
FIG. 3A is a schematic of a layered magnet assembly having alternating layers of a mixture of HRE containing material and electrically insulating material and a magnetic powder.
Figure 3B:
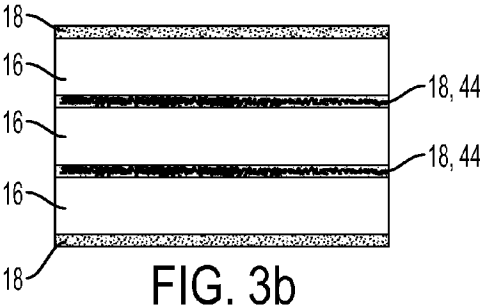
FIG. 3B is a schematic of the layered assembly of FIG. 3A pressed into a green compact.
Figure 3C:
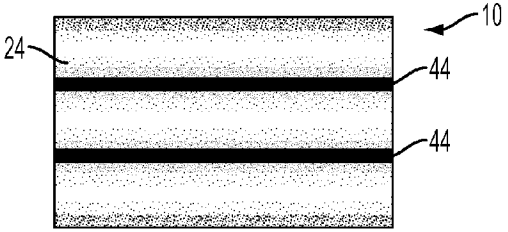
FIG. 3C is a schematic of the green compact of FIG. 3B sintered into a magnet having HRE containing material present throughout the bulk of the magnet and spaced apart electrically insulating material layers.

With reference to FIGS. 3A to 3C, the layered assembly process including electrically insulating material 40 is shown. The electrically insulating material 40 may be mixed with the HRE-containing material 14 in each layer 18 of HRE-containing material, in some layers and not others, or it may be present as a separate, distinct layer 44. As shown in FIG. 3A, the electrically insulating material 40 is mixed in with the HRE-containing material 14 in all of the internal layers, but not in the surface layers, of HRE-containing material 14. FIG. 3B shows the layered assembly following pressing under external magnetic field 22, with the electrically insulating material 40 and HRE-containing material 14 disposed in layers between the magnetic powder. By controlling the sintering time and temperature and the choice of insulating material, a permanent magnet 10 can be formed having HRE material 14 diffused into the grain boundaries and grain outer shells and the insulation material 40 still substantially in its original position between layers of magnetic powder 16, as shown in FIG. 3C. The insulating material 40 may stay in its original position at least in part due to immiscibility with the other materials present. The electrically insulating material thereby forms electrical insulation layers 44 separating magnetic layers 16 of high coercivity within the magnet. In another embodiment, rather than the electrically insulating material 40 staying in its original position, it may diffuse within the magnetic powder along with the HRE-containing material 14, however not necessarily to the same depth. In this embodiment, eddy current loss may be further reduced through resistivity enhancement by the insulating material 40 diffusing to the grain boundaries. The processing conditions used to form magnets with HRE and insulating layers may be similar to or the same as for magnets with HRE layers only, which are described above.

In addition to the electrically insulating materials described above, such as fluorides or oxides, the electrically insulating material 40 may include a magnetic material 46. Using electrically insulating materials that are also magnetic materials may result in a magnet having superior magnetic properties compared to a magnet using non-magnetic insulating material because there is no "wasted" volume within the magnet that is not contributing to the magnetic strength. The magnetic insulating material 46 may be any suitable material that is both magnetic and electrically insulating. In at least one embodiment, the magnetic insulating material 46 has "hard" magnet properties. A non-exhaustive list of possible materials may include iron oxide, barium ferrite powders, strontium ferrite powders, or others. The magnetic insulating material 46 may also include magnetic materials that are coated with an electrically insulating material, for example, iron powders with an insulating coating.

In at least one embodiment, the magnetic insulating material 46 may be mixed with the HRE-containing material 14, as described above for the electrically insulating material 40. In other embodiments, however, the magnetic insulating material 46 may replace the HRE-containing material in the layered assembly such that the assembly includes alternating layers of magnetic powder 12 and magnetic insulating material 46. This layered assembly may be prepared, compacted, and sintered using substantially the same methods as described above. The resulting magnet may be cheaper to produce than those including HRE layers 18, but may offer substantially reduced eddy current losses compared to standard magnets. As shown in FIGS. 4A-4D, the layers 48 of magnetic insulating material 46 may be oriented such that they are perpendicular, parallel, or at an oblique angle to the c-axis of the magnetic hard phase by aligning the layers appropriately under the magnetic field 22 during the pressing process. The magnetic insulating material 46 may also be formed in a networked pattern having intersecting layers 48 of the material in order to further enhance electrical resistivity within the magnet 10.

While embodiments described above include a layered structure having multiple layers of magnetic material 12 and layers of HRE material 14, the process described may also be used to form a magnet structure similar to those formed using the conventional GBDP. An HRE-containing-layer 18 may be layered on top and bottom while a layer of magnetic material 12 is disposed in between. This method may therefore produce a GBDP-type magnet structure in a single step heat treatment, rather than the conventional method requiring two steps: sintering first and then diffusion heat treatment. This method may then save time and cost for the same magnet structure and properties.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A magnet comprising:

a single sintered magnet having a concentration profile of heavy rare-earth (HRE) elements across an entire width of the magnet within a continuously sintered rare-earth (RE) magnet bulk;

wherein the concentration profile is substantially sinusoidal in shape along an entire thickness of the magnet such that a corresponding coercivity profile across the entire width of the magnet is substantially sinusoidal in shape along an entire thickness of the magnet.

2. The magnet of claim 1, wherein the single sintered magnet has a thickness greater than 15 mm.

3. The magnet of claim 1, wherein the RE magnet bulk includes at least one of an RE-Fe—B or Sm—Co alloy.

4. The magnet of claim 1 further comprising electrically insulating material within the bulk.

5. The magnet of claim 4, wherein the electrically insulating material is formed as at least one layer within the bulk.

6. The magnet of claim 4, wherein there is a concentration profile of electrically insulating material across the entire width of the magnet within the bulk that is periodic, having alternating relative maximums and minimums along the thickness of the magnet.

7. The magnet of claim 4, wherein the electrically insulating material includes a magnetic material.

8. The magnet of claim 7, wherein the electrically insulating material includes one or more of the group consisting of iron oxide, barium ferrite powders, and strontium ferrite powders.

9. A magnet comprising:

a single sintered magnet having a concentration profile of heavy rare-earth (HRE) elements across an entire width of the magnet within a continuously sintered rare-earth (RE) magnet bulk; and a magnetic and electrically insulating material disposed within the magnet bulk;

wherein the concentration profile is substantially sinusoidal in shape along an entire thickness of the magnet such that a corresponding coercivity profile across the entire width of the magnet is substantially sinusoidal in shape along an entire thickness of the magnet.

10. The magnet of claim 9, wherein the magnetic and electrically insulating material is formed as at least one layer within the bulk.

11. The magnet of claim 9, wherein there is a concentration profile of the magnetic and electrically insulating material across the entire width of the magnet within the bulk that is periodic, having alternating relative maximums and minimums along the thickness of the magnet.

12. The magnet of claim 9, wherein the magnetic and electrically insulating material includes one or more of the group consisting of iron oxide, barium ferrite powders, and strontium ferrite powders.

13. The magnet of claim 9, wherein the magnetic and electrically insulating material includes a magnetic material coated with an electrically insulating material.

14. A rare-earth magnet comprising:

a green compact including a plurality of compressed layers of magnetic powder including a rare-earth element or alloy extending an entire width of the green compact and at least two layers of a material including a heavy rare earth (HRE) element or alloy extending an entire width of the green compact within a bulk of the green compact between the compressed layers of magnetic powder; wherein a concentration profile is substantially sinusoidal in shape along an entire thickness of the magnet such that a coercivity profile across the entire width of the magnet is substantially sinusoidal in shape along an entire thickness of the magnet.

* * * * *